US009691545B2

(12) United States Patent
Mccall et al.

(10) Patent No.: US 9,691,545 B2
(45) Date of Patent: Jun. 27, 2017

(54) DEVELOPING BULK EXCHANGE SPRING MAGNETS

(71) Applicant: LAWRENCE LIVERMORE NATIONAL SECURITY, LLC, Livermore, CA (US)

(72) Inventors: Scott K. Mccall, Livermore, CA (US); Joshua D. Kuntz, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 15/007,412

(22) Filed: Jan. 27, 2016

(65) Prior Publication Data

US 2016/0163449 A1 Jun. 9, 2016

Related U.S. Application Data

(62) Division of application No. 13/777,163, filed on Feb. 26, 2013, now abandoned.

(60) Provisional application No. 61/616,376, filed on Mar. 27, 2012.

(51) Int. Cl.

| | |
|---|---|
| ***H01F 41/02*** | (2006.01) |
| ***C25D 13/12*** | (2006.01) |
| ***C25D 13/02*** | (2006.01) |
| ***H01F 1/03*** | (2006.01) |
| ***H01F 41/00*** | (2006.01) |
| ***H01F 1/057*** | (2006.01) |

(52) U.S. Cl.

CPC ..... *H01F 41/0253* (2013.01); *C25D 13/02* (2013.01); *C25D 13/12* (2013.01); *H01F 1/0302* (2013.01); *H01F 1/0579* (2013.01); *H01F 41/00* (2013.01); *Y10T 29/49* (2015.01)

(58) Field of Classification Search

None

See application file for complete search history.

(56) References Cited

U.S. PATENT DOCUMENTS

| | | | |
|---|---|---|---|
| 6,736,909 | B2 | 5/2004 | Waki et al. |
| 7,344,605 | B2 | 3/2008 | Ono et al. |
| 2002/0000262 | A1 | 1/2002 | Ono et al. |
| 2002/0036559 | A1 | 3/2002 | Waki et al. |
| 2008/0199715 | A1 | 8/2008 | Shimada et al. |

(Continued)

FOREIGN PATENT DOCUMENTS

JP 2000208313 A 7/2000

OTHER PUBLICATIONS

Goll et al., "High-Performance Permanent Magnets", Naturwissenschaften (2000) 87:423-438, Springer-Verlag.

(Continued)

*Primary Examiner* — Kishor Mayekar

(74) *Attorney, Agent, or Firm* — Eddie E. Scott

(57) ABSTRACT

A method of making a bulk exchange spring magnet by providing a magnetically soft material, providing a hard magnetic material, and producing a composite of said magnetically soft material and said hard magnetic material to make the bulk exchange spring magnet. The step of producing a composite of magnetically soft material and hard magnetic material is accomplished by electrophoretic deposition of the magnetically soft material and the hard magnetic material to make the bulk exchange spring magnet.

5 Claims, 5 Drawing Sheets

(56) References Cited

U.S. PATENT DOCUMENTS

2010/0315191 A1* 12/2010 Xiao ..... B82Y 25/00
336/200
2014/0132376 A1* 5/2014 Jin ..... C22C 38/10
335/302

OTHER PUBLICATIONS

Zeng et al., "Exchange-Coupled Nanocomposite Magnets by Nanoparticle Self-Assembly", Nature, vol. 420, 2002, pp. 395-398.

* cited by examiner

DEVELOPING BULK EXCHANGE SPRING MAGNETS

CROSS-REFERENCE TO RELATED APPLICATIONS

The present application is a Division of application Ser. No. 13/777,163 filed Feb. 26, 2013, which claims benefit under 35 U.S.C. §119(e) of U.S. Provisional Patent Application No. 61/616,376 filed Mar. 27, 2012 entitled "developing bulk exchange spring magnets," the disclosure of which is hereby incorporated by reference in its entirety for all purposes.

STATEMENT AS TO RIGHTS TO INVENTIONS MADE UNDER FEDERALLY SPONSORED RESEARCH AND DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

BACKGROUND

Field of Endeavor

The present invention relates to magnets and more particularly to bulk exchange spring magnets.

State of Technology

The energy density (or energy product) of a magnet is the amount of useful magnetic work that can be extracted from a magnet and is a function of the remanence and coercivity of the magnet. Exchange spring magnets (ESM) are metamaterials consisting of magnetically soft particles with a large remanence, such as iron or permendur—intimately coupled to hard magnetic particles such as $SmCo_5$ or $Nd_2Fe_{14}B$. The resulting composite benefits from the best properties of its constituent materials to form a magnet with a superior energy density. While the best magnets available today have energy densities ~400 kJ/m$^3$, the upper limit on a well designed ESM approaches 1 MJ/m$^3$.

The challenge in producing high performing ESMs has been the inability to precisely control the spacing of the particles and the coupling between them. Electrophoretic deposition (EPD) is a processing method which utilizes the induced surface charge particles exhibit when placed in both aqueous and organic liquids. The surface charge is then used to control the motion of the particles in suspension in the presence of electric fields. As such, EPD is the particle level equivalent of electroplating and permits the precise control of particles needed to manufacture superior ESMs with energy products approaching the theoretical maximum.

U.S. Pat. No. 7,344,605 for an exchange spring magnet powder and a method of producing the same provides the state of technology information quoted below:

"As related permanent magnet materials, ferrite magnets which are chemically stable and inexpensive and rare earth metal-based magnets having high ability are practically used. These magnets are constituted of approximately a single compound as a magnet compound, and recently, exchange spring magnets are noticed which are obtained by complexing a permanent magnet material having high coercive force with a soft magnetic material having high magnetic flux density."

"Such exchange spring magnets are expected to have high maximum energy product, and theoretically, extremely high magnetic property of 100 MGOe (.apprxeq. 796 kJ/m$^3$) or more can be realized."

U.S. Pat. No. 6,736,909 for a bulk exchange-spring magnet, device using the same, and method of producing the same provides the state of technology information quoted below:

"In general, the structure of the exchange-spring magnet is composed of a plurality of laminated thin films of a hard and soft phase or of the soft phase composed of fine grains dispersed in basic structures of the hard phase, and is termed as a nanocomposite structure. The presence of the laminated structure of the thin films or the dispersed structure of the fine grains in a macrostructure results in mere coexistence of the hard phase and the soft phase in the magnet structure with a demagnetization curve, which represents the magnet properties, tracing a snake profile. When, however, the nanoscale domain is composed of the laminated structure or the grain dispersed structure, the magnetization of the hard phase is strongly restricted with the magnetization of the soft phase such that the nanoscale domain entirely behaves as it were a single hard phase. That is, when the exchange-spring magnet, wherein magnetization is aligned in one direction, is applied with the demagnetizing field in a negative direction, a reversal in magnetization occurs from an intermediate portion of the soft phase, with the magnetization, in the vicinity of the magnetic domain wall between the hard phase and the soft phase, remaining in its aligned condition in a positive direction owing to a strong exchange-force. Under such a condition, if the demagnetizing field is released, the magnetization returns along the demagnetization curve. Since this action is resembled to a spring action, the magnet is termed an exchange-spring magnet. Also, the word "exchange" is employed as an initial because its theory is based on an mutual exchange interaction."

"For example, it is considered below about a strong magnetic composite wherein an axis of easy magnetization is oriented in one direction and the hard and soft phases are alternately laminated. When magnetically saturating the composite in a positive direction and subsequently applying the demagnetizing field to the composite in a negative direction, the magnetization is first reversed at the center of the soft phase. At the boundaries between the hard and soft phases, the magnetization of the soft phase is hard to be reversed because the orientation of the magnetization at the soft phase is restricted by the orientation of the magnetization of the hard phase owing to the exchange interaction with magnetic moment at the hard phase. While the magnetic moment at the hard phase may be slightly varied in orientation of the magnetization at the boundaries between the hard phase and the soft phase, the presence of the smaller magnetic field in the magnetization of the hard phase than that of the boundaries wherein the magnetization is irreversibly reversed allow the applied magnetic field to be returned to a zero state such that the system is subjected to a spring back to its original state. If the hard phase is applied with a greater magnetization than the magnetic field that is irreversibly reversed, the magnetization of the entire system is also irreversibly reversed such that the system is saturated in the negative direction."

"In general, what the maximum energy product of the magnet is limited depends on the magnetization of the compound which functions as a main phase. The nanocomposite magnet has shown to theoretically surpass the limit of the performance of the magnet, which has been currently in practical use, such that the nanocomposite magnet surpasses the theoretical value of the maximum energy product of 120 MGOe (about 9.6 MJ/m.sup.3) of anistropic multi layers."

"For all of these various reasons, the spotlight is focused on the exchange-spring magnet as a new magnetic material. The exchange-spring magnet has been usually developed mainly for the compound system composed of a hard phase containing a Nd—Fe—B system or a Sm—Fe—N system and a soft phase containing Fe—B or Fe—Co compounds. Japanese Patent Provisional Publication No. 2000-208313 discloses a technology for obtaining an anistropic exchange-spring magnet powders in finer grains with superior magnetic properties by repeatedly implementing an amorphous processing step and a crystalline processing step."

"As discussed above, the exchange-spring magnet theoretically tends to have the extremely high maximum energy product, though implementation of a full dense treatment of the exchange-spring magnet powders causes the exchange-spring magnet powders to be coarse in grain size at such a high sintering temperature of 1000.degree. C. required in the related art technologies, with resultant remarkably degraded magnetic properties (i.e., the maximum energy product). Therefore, it becomes difficult for the exchange-spring magnet powders to be densified in full dense state while maintaining the finer grain sizes of the magnet powders. Accordingly, in order to avoid the coarse grain growth, an extensive study has been conducted to apply the exchange-spring magnet powders to a so-called bonded magnet (in other word, a so-called plamag, plastic magnet or rubber magnet) wherein the magnet powders are mixed with plastic resin or rubber, followed by solidification of the magnet into a desired profile."

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides bulk exchange spring magnets (ESMs), an engineered class of superior permanent magnets—using electrophoretic deposition. Production of high-energy-density magnets is vitally important for energy efficiency applications that require compact motors or generators. Examples include regenerative braking in hybrid automobiles and generators in megawatt-scale windmills as well as many portable devices such as laptop hard disk drives. Currently this role is filled by rare earth element (REE) magnets such as $Nd_2Fe_{14}B$ and $SmCo_5$. The majority of the REE required for these magnets as well as the magnets themselves are imported from China as the current U.S. manufacturing capabilities are miniscule. The present invention will enable a new class of permanent magnets with higher performance at lower cost and with lower energy inputs required for manufacture.

In one embodiment the present invention provides a method of making a bulk exchange spring magnet by providing a magnetically soft material, providing a hard magnetic material, and producing a composite of said magnetically soft material and said hard magnetic material to make the bulk exchange spring magnet. In one embodiment the step of producing a composite of magnetically soft material and hard magnetic material is accomplished by electrophoretic deposition of the magnetically soft material and the hard magnetic material to make the bulk exchange spring magnet.

The present invention has use anywhere it is desirable to convert electrical energy to or from mechanical energy. This includes energy applications such as motors and generators, particularly those where size and weight limitations are important such as in hybrid or all electric cars, but also in wind turbines. This also includes products such as compact hard disk drives, cell phone motors, and other uses of small efficient motors. Beyond these, miniaturized transducers, such as speakers and microphones are applications of the present invention.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

FIG. 2A shows a high remanence soft magnet and much harder magnet with a lower remanence, with the hatched area representing the energy density (product). FIG. 2B shows an exchange spring magnet consisting of the hard and soft magnets demonstrating improved remanence, coercivity, and a much larger energy density as illustrated from the cross hatched area.

DETAILED DESCRIPTION OF SPECIFIC EMBODIMENTS

Figure 1:
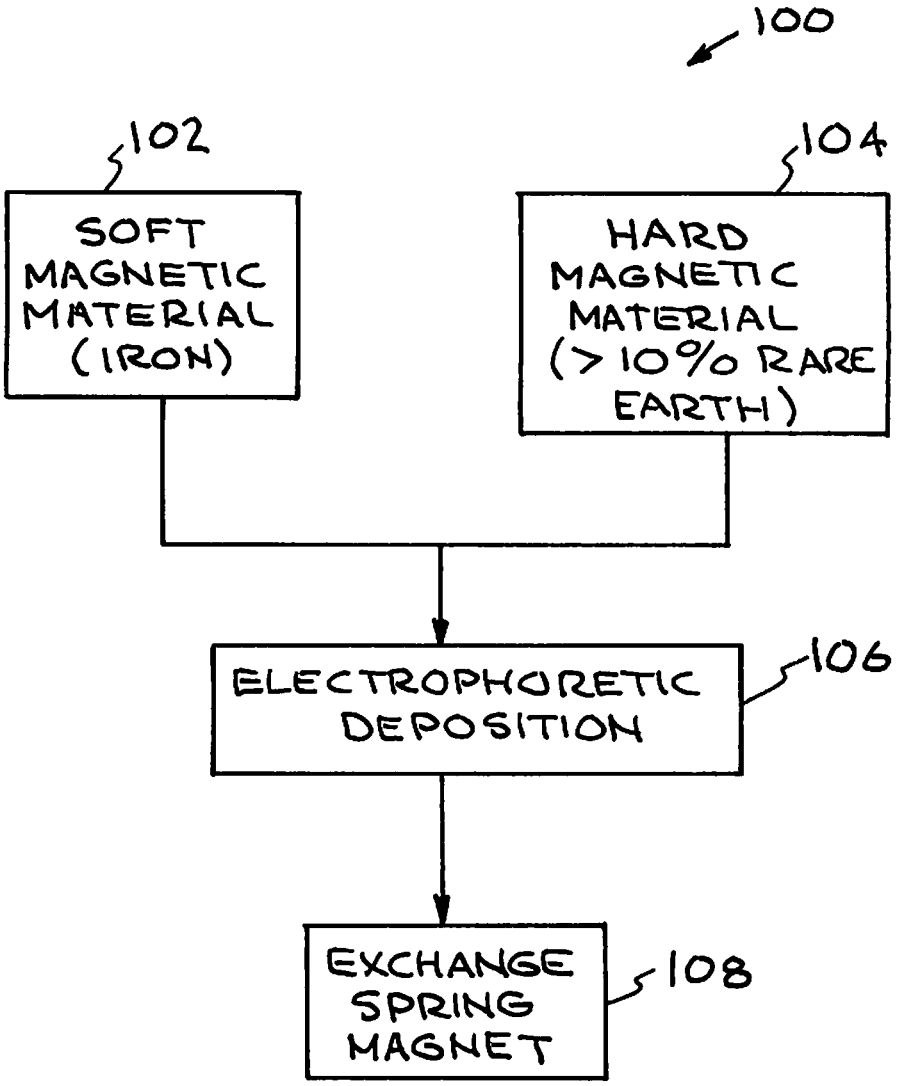
FIG. 1 is a flow chart illustrating the making of a bulk exchange spring magnet of the present invention.

Referring to the drawings, to the following detailed description, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

Referring now to the drawings and in particular to FIG. 1, a flow chart illustrates one embodiment of a method of making a bulk exchange spring magnet of the present invention. The method is designated generally by the reference numeral 100.

As illustrated in FIG. 1, the method 100 includes a number of steps. In step 102 a magnetically soft material is provided. In step 104 a hard magnetic material is provided. In various embodiments of the invention the hard magnetic material contains less than twenty atomic percent rare earths.

In step 106 a composite of said magnetically soft material and said hard magnetic material is produced. In step 108 the composite is used to make the bulk exchange spring magnet. In step 106 a hard magnet and a soft magnet are combined on the nanoscale to exploit the advantages of each—a larger magnetic remanence/saturation coupled to a large coercivity. Step 106 requires the reliable creation of both hard and soft magnetic materials on the nanometer scale (<10 nm) and that can control their deposition so that they are built up brick by brick with the separation between the hard particles being smaller than a Bloch wall, which is the distance over which the alignment of moments can flip. Step 106 exploits electrophoretic deposition, which allows nanoscopic control of particle position.

Figure 2A:
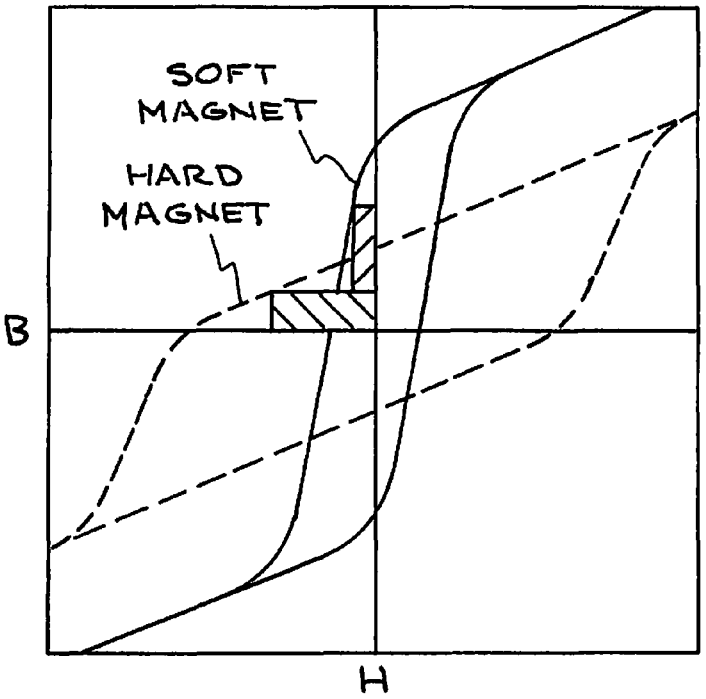
FIGS. 2A and 2B are graphs of the Applied Magnetic Field vs Magnetic Induction illustrating hysteresis loops.
Figure 2B:
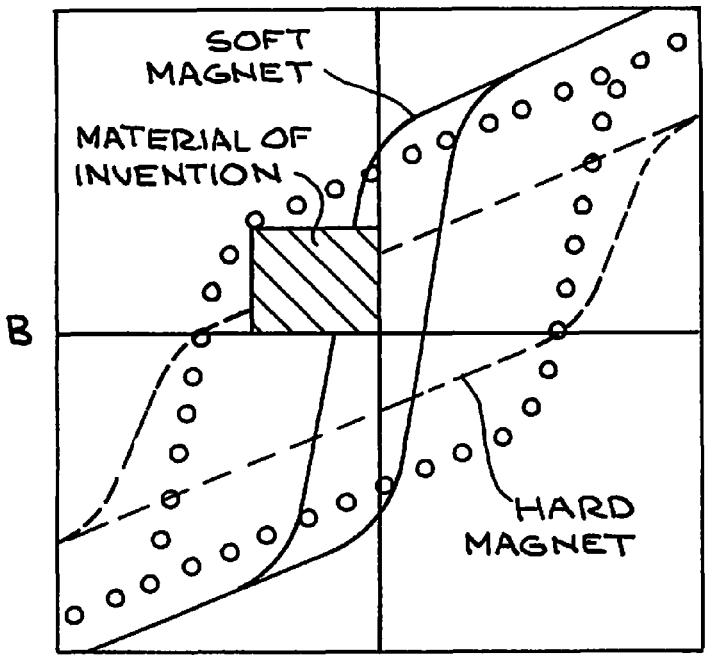

Referring now to FIGS. 2A and 2B, graphs of Applied Magnetic Field vs Magnetization illustrate hysteresis loops showing a high remanence soft magnet and much harder magnet with a lower remanence (dashed line). The figure of merit for a permanent magnet is the energy product (or energy density), E, which describes the potential amount of work one can extract from the magnet. This value is determined by the maximum of (BH) in the second quadrant of the magnet's hysteresis loop, also known as the demagnetization curve, where H is the magnetic field strength and B is the magnetic induction. These two terms are related by the equation $B=\mu_o(H+M)$, where M is the magnetization and $\mu_o$ is the permeability of free space ($4\pi\times10^{-7}$ Tm/A), a constant. $(BH)_{Max}\leq\mu_o Ms^2/4$, where $M_s$ is the saturation magnetization, so this is a limiting factor for the energy density.

There are magnets with very high remnant magnetization (the magnetization that remains when the applied field is removed), that however have very low coercivities (the point at which the magnetization goes to zero), and so are known as soft magnets. Materials that have very high coercivities are hard magnets.

The ideal magnet would have an extremely large remnant magnetization and a very high coercivity, thus maximizing the overall energy product. In reality, there are compromises made between maximizing the coercivity and remnant magnetization.

The present invention provides an exchange spring magnet wherein a hard magnet and a soft magnet are combined on the nanoscale to exploit the advantages of each—a larger magnetic remanence/saturation coupled to a large coercivity. FIG. 2A shows the respective energy densities for a soft and hard magnet, given by the hatched areas. The material of the present invention is represented by the cross-hatched area of FIG. 2B, demonstrating a much larger energy density. The present invention reliably creates both hard and soft magnetic materials on the nanometer scale (<10 nm) and controls their deposition so that they are built up brick by brick with the separation between the hard particles being smaller than a Bloch wall, which is the distance over which the alignment of moments can flip. The present invention exploits electrophoretic deposition, which allows nanoscopic control of particle position.

The challenge in producing high performing ESMs has been the inability to precisely control the spacing of the particles and the coupling between them. Electrophoretic deposition (EPD) is a processing method which utilizes the induced surface charge particles exhibit when placed in both aqueous and organic liquids. The surface charge is then used to control the motion of the particles in suspension in the presence of electric fields. As such, EPD is the particle level equivalent of electroplating and permits the precise control of particles needed to manufacture superior ESMs with energy products approaching the theoretical maximum.

By controlling certain characteristics of formation of structures in an EPD process, such as the precursor material composition (e.g., homogenous or heterogeneous nanoparticle solutions) and orientation (e.g., non-spherical nanoparticles), deposition rates (e.g., by controlling an electric field strength, using different solvents, particle concentration, etc.), material layers and thicknesses (e.g., through use of an automated sample injection system and deposition time), and deposition patterns with each layer (e.g., via use of dynamic electrode patterning), intricate and complex structures may be formed using EPD processes that may include a plurality of densities, microstructures (e.g., ordered vs. random packing), and/or compositions, according to embodiments described herein.

Figure 3A:
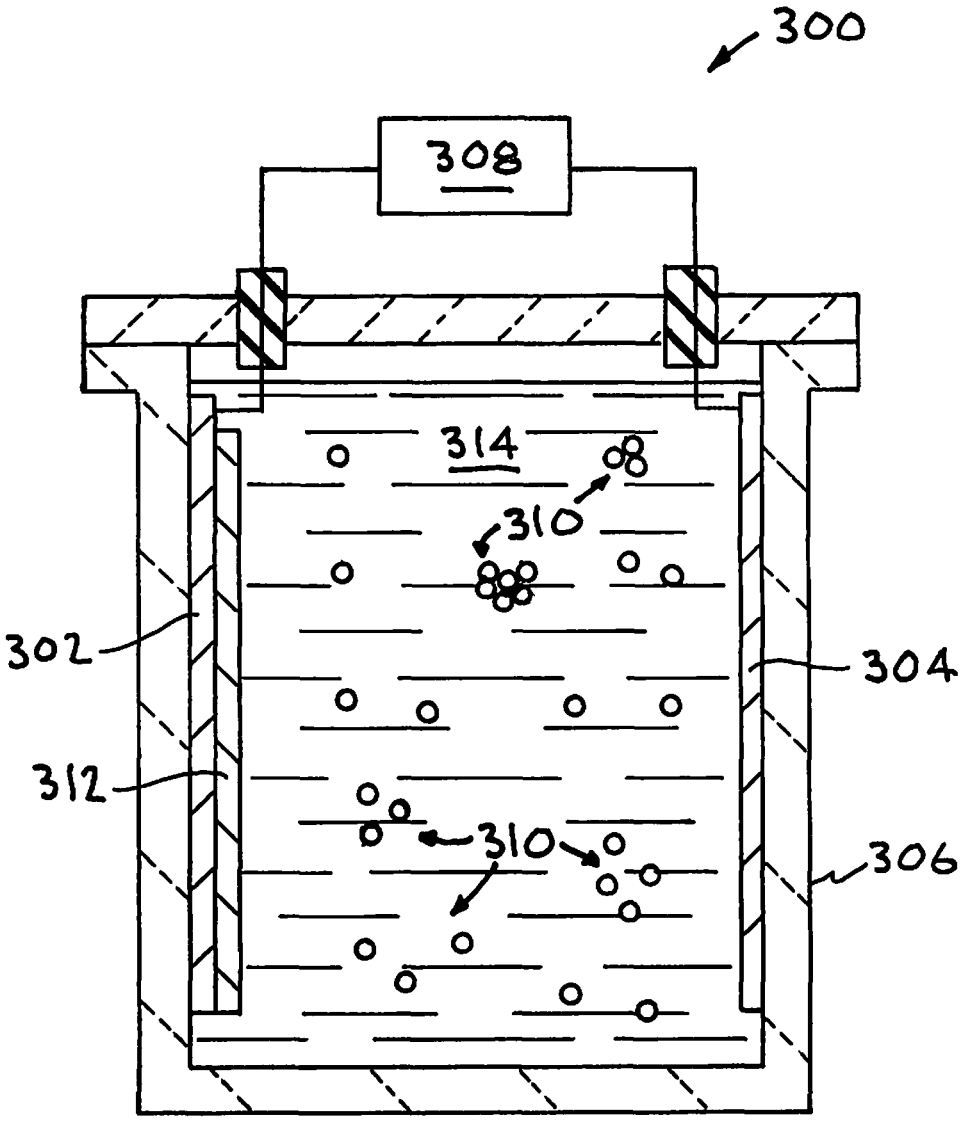
FIGS. 3A and 3B illustrate electrophoretic deposition (EPD).

Referring now to FIG. 3A, an electrophoretic deposition (EPD) device is illustrated. The EPD device is designated generally by the reference numeral 300. The EPD device 300 includes a first electrode 302 and a second electrode 304 positioned on either side of an EPD chamber 306, with a voltage difference 308 applied across the two electrodes 302, 304 that causes charged particles 310 in a solution 314 to move toward the first electrode 302. In some embodiments, a substrate 312 is placed on a solution side of the first electrode 302 such that particles 310 collect thereon. The EPD device 300 is used to attract particles 310 toward the first electrode 110 or toward the conductive or non-conductive substrate 312 positioned on a side of the electrode 302 exposed to a solution 314.

Figure 3B:
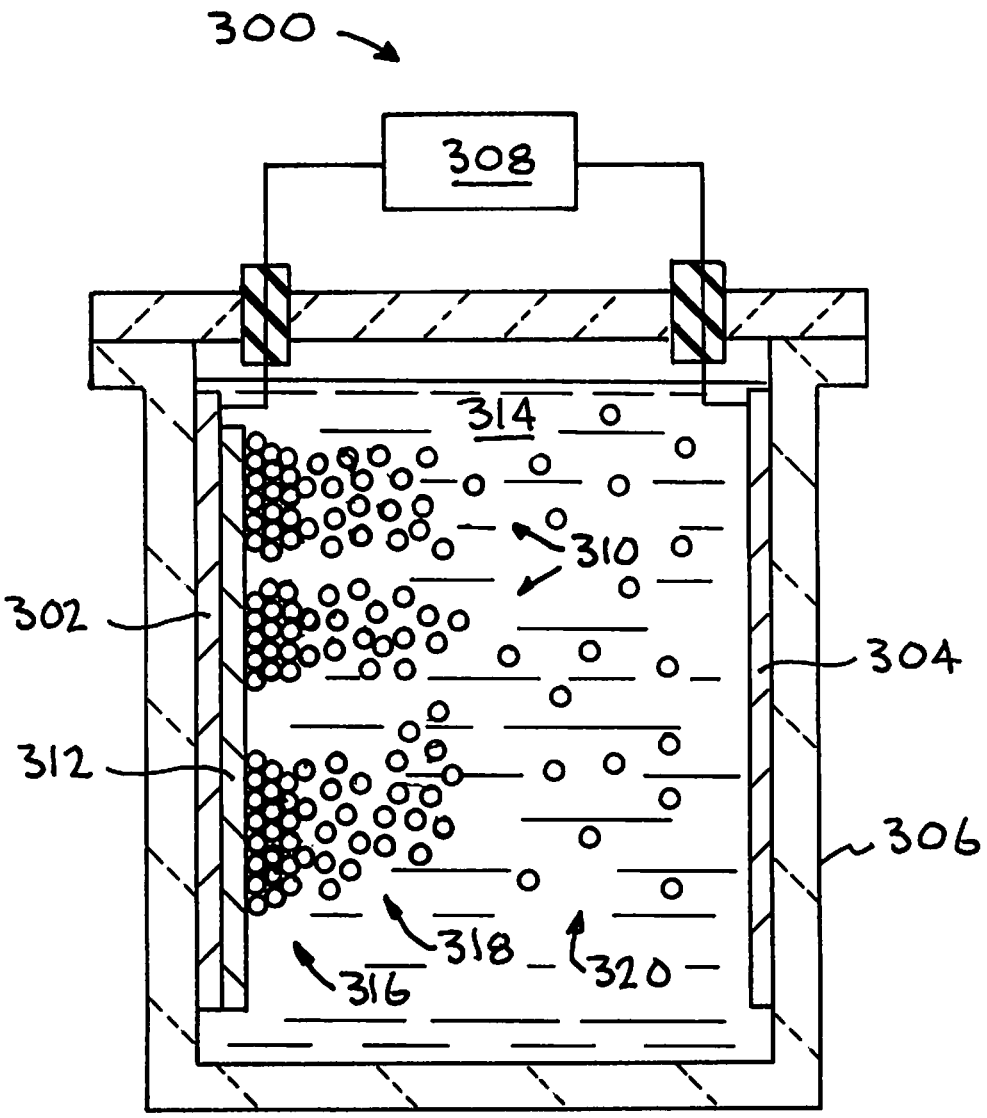

Referring now to FIG. 3B, additional details about the EPD device and EPD process is illustrated. The EPD device is designated generally by the reference numeral 300. The EPD device 300 is used to attract the particles 310 toward the first electrode 110 or toward the conductive or non-conductive substrate 312 positioned on a side of the electrode 302 exposed to the solution 314.

By controlling certain characteristics of formation of structures in the EPD process, such as the precursor material composition (e.g., homogenous or heterogeneous nanoparticle solutions) and orientation (e.g., non-spherical nanoparticles), deposition rates (e.g., by controlling an electric field strength, using different solvents, particle concentration, etc.), material layers and thicknesses (e.g., through use of an automated sample injection system and deposition time), and deposition patterns with each layer (e.g., via use of dynamic electrode patterning), intricate and complex structures may be formed using EPD processes that may include a plurality of densities, microstructures (e.g., ordered vs. random packing), and/or compositions, according to embodiments described herein.

As illustrated in FIG. 3B, the particles 310 are drawn toward the first electrode 110 and the conductive or non-conductive substrate 312. By controlling the electric field strength and using different solvents the particle concentration is controlled to produce material layers it is possible to produce intricate and complex structures. The changes in particle concentration producing the material layers are illustrated by the areas designated by the arrows 316, 318 and 320. By controlling the electric field 308 and the different solvents 314 the particle concentration is controlled to produce the bulk exchange spring magnet of the present invention. The EPD process is used to provide a first component characterized as a magnetically soft material and a second component characterized as a hard magnetic material. The first component and said second component are deposited by an electrophoretic deposition process to produce a bulk exchange spring magnet that is a composite of said magnetically soft material and said hard magnetic material.

Figure 4:
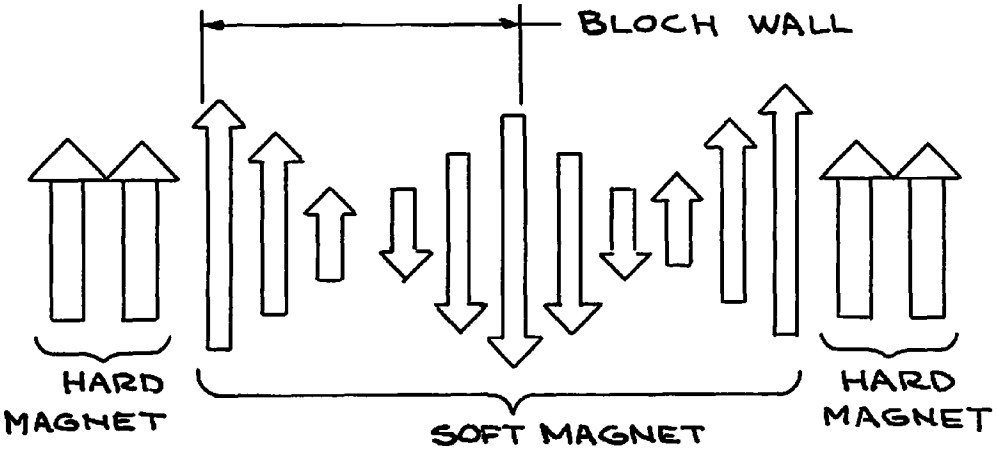
FIG. 4 (PRIOR ART)
FIG. 4 is an illustration of the prior art.

Referring to FIG. 4, the prior art is illustrated. Control of the separation distance between neighboring hard magnets is critical. If they are too far apart, the energy product will be lower than desired. The Bloch wall is defined as the boundary between two domains in a magnetic material marked by a layer wherein the direction of magnetization is assumed to change gradually from one domain to the other.

Figure 5:
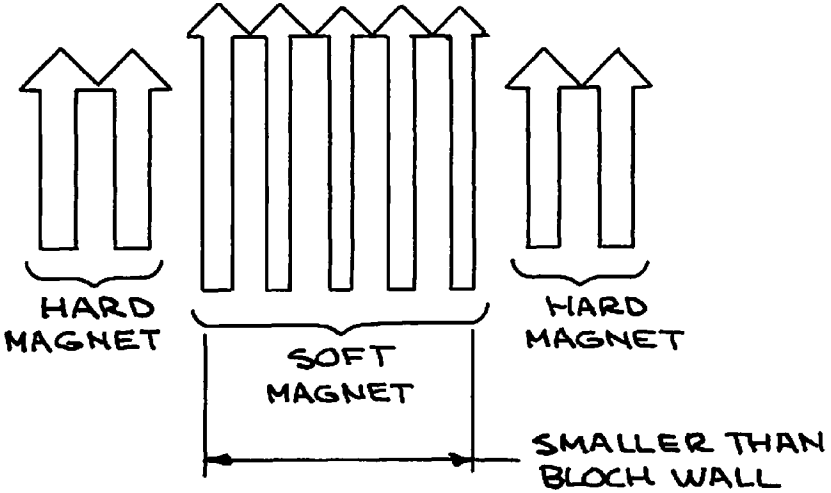
FIG. 5 illustrates the making of a bulk exchange spring magnet of the present invention built up brick by brick with the separation between the hard particles being smaller than a Bloch wall.

Referring now to FIG. 5, the making of a bulk exchange spring magnet of the present invention is illustrated. The present invention reliably creates both hard and soft magnetic materials on the nanometer scale (<10 nm) by controlling their deposition so that they are built up brick by brick with the separation between the hard particles being smaller than a Bloch wall, which is the distance over which the alignment of moments can flip.

The present invention provides the production of a stable suspension, of mixed composition, consisting of nanoscale hard magnetic particles such as SmCo5, along with soft iron nanoparticles. This suspension is deposited on to a substrate and consolidated to a dense composite. The composition and microstructure of the final ESM is determined by control of both the composition and deposition rates of the particles in suspension. The present invention provides a practical method to assemble building blocks at the scale of tens of nanometers—the precise range at which magnetic properties are projected to be optimal.

Magnets, through generators and motors, are the primary mechanism for converting between mechanical energy and electrical energy. Improving the strength of magnets will increase the efficiencies while permitting lighter, more compact designs. Such improvements will engender improved regenerative braking systems and can be expected to increase the range of all-electric vehicles making them more commercially viable. Similarly these magnets will allow smaller, lighter, and less expensive turbines for large scale windmills thus reducing both the energetic and financial costs of installation. The development of REE permanent magnets has made many modern devices practical. Without these magnets, the current design of regenerative braking in hybrid automobiles would not be feasible due to the order-of-magnitude increase in size of the non-REE magnets required, and commensurate increase in motor/generator size. Consumer products, such as compact hard disk drives necessary for laptop computers, also rely on high-strength magnets. An improved magnet will reduce the size of motors and generators, permitting efficiency gains in mobile systems due to the reduction in size and weight, and open the way to new applications not currently practical. The annual global market for permanent magnets exceeds $10 billion, with more than half of that value in REE magnets. Bulk ESMs have the potential to replace most of the REE magnet market at a considerably lower overall cost.

While the invention may be susceptible to various modifications and alternative forms, specific embodiments, have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method of making a bulk exchange spring magnet, comprising the steps of:

providing a magnetically soft material component made of nanometer size magnetically soft materials, providing a hard magnetic material component made of nanometer size hard magnetic materials, producing a composite of said magnetically soft material component and said hard magnetic material component by electrophoretic deposition of said nanometer size magnetically soft materials and said nanometer size hard magnetic materials, controlling said electrophoretic deposition of said nanometer size magnetically soft materials and said nanometer size hard magnetic materials to provide a separation between said magnetically soft material component and said hard magnetic material component, and controlling said electrophoretic deposition of said nanometer size magnetically soft materials and said nanometer size hard magnetic materials so that said separation between said magnetically soft material component and said hard magnetic material component is smaller than a Bloch wall to make the bulk exchange spring magnet.

2. The method of making a bulk exchange spring magnet of claim 1 wherein said step of providing a hard magnetic material component comprises providing a hard magnetic material component made of nanometer size hard magnetic materials including rare earths and wherein said hard magnetic material component contains less than twenty atomic percent rare earths of said hard magnetic material component.

3. A method of producing an exchange spring magnet, comprising the steps of:

providing a magnetically soft material component made of nanometer size magnetically soft materials, providing a hard magnetic material component made of nanometer size hard magnetic materials, producing a composite of said magnetically soft material component and said hard magnetic material component by electrophoretic deposition using an electrophoretic deposition device to produce said composite of said nanometer size magnetically soft materials and said nanometer size hard magnetic materials, controlling said electrophoretic deposition device and said electrophoretic deposition of said nanometer size magnetically soft materials and said nanometer size hard magnetic materials to provide a separation between said magnetically soft material component and said hard magnetic material component, and controlling said electrophoretic deposition device and said electrophoretic deposition of said nanometer size magnetically soft materials and said nanometer size hard magnetic materials so that said separation between said magnetically soft material component and said hard magnetic material component is smaller than a Bloch wall to produce the exchange spring magnet.

4. The method of producing an exchange spring magnet of claim 3 wherein said step of electrophoretic deposition includes electrophoretic deposition of $Nd_2Fe_{14}B$.

5. The method of producing an exchange spring magnet of claim 3 wherein said step of providing a hard magnetic material component comprises providing a hard magnetic material component made of nanometer size hard magnetic materials including rare earths and wherein said hard magnetic material component contains less than twenty atomic percent rare earths of said hard magnetic material component.

* * * * *